US005540445A

United States Patent [19]

Lee

[11] Patent Number: 5,540,445

[45] Date of Patent: Jul. 30, 1996

[54] ELECTRONIC DART DEVICE FOR CRICKET GAME

[75] Inventor: Min-Shiung Lee, Taipei Hsien, Taiwan

[73] Assignee: Chun-Mu Huang, Sanchung, Taiwan

[21] Appl. No.: 466,226

[22] Filed: Jun. 6, 1995

[51] Int. Cl.[6] ..... F41J 3/02

[52] U.S. Cl. ..... 273/371

[58] Field of Search ..... 273/371, 372, 273/373, 374, 376, 377

[56] References Cited

U.S. PATENT DOCUMENTS 4,567,461 1/1986 Honekman et al. ..... 340/323 R 5,318,319 6/1994 Jones et al. ..... 273/371

*Primary Examiner*—William H. Grieb

*Attorney, Agent, or Firm*—Knobbe, Martens, Olson & Bear

[57] ABSTRACT

The present invention provides an electronic dart device for playing a cricket game, which includes a dart panel having a plurality of dart regions, a plurality of target blocks respectively received in the plurality of dart regions, a sensing matrix circuit in contact with one of the target blocks when the one target block is hit with a dart, a digital display mounted on the dart panel for displaying a sign denoting a time the one block has been hit with a dart in a first instance and a number denoting a score the one block is programmed to have in a second instance, and a control circuit electrically connected to the matrix circuit and the digital display for controlling the digital display to display one of the sign and the number when the one block is hit with a dart. Preferably, the present electronic dart device can use the digital display mounted on the dart device for displaying the cricket game result so as to reduce the area of the dart panel and decrease the cost.

6 Claims, 7 Drawing Sheets

ELECTRONIC DART DEVICE FOR CRICKET GAME

FIELD OF THE INVENTION

The present invention relates to an electronic dart device, and more particularly to an electronic dart device for playing a cricket game and showing a play result.

BACKGROUND OF THE INVENTION

Cricket is a popular game having many play regulations due to improvements in dart devices.

Earlier prior dart devices such as that shown in FIG. 1 include a woody panel 1 divided into several target blocks 11 and a bull's-eye 12. The player throws metal-pointed darts to the panel 1 and gains points according to the respective target blocks 11 which have been hit by darts. But, since the dart device shown in FIG. 1 is made of wood and has no electronic device, the manual scoring of the cricket game becomes inconvenient and/or boresome.

Another dan device, shown in FIG. 2, was created to prevent the inconvenience of manual scoring. This dart device includes a dart panel 2 having target blocks 21 and four 7-segment digital display sets 22. A set of electronic circuits (not shown) mounted on the back of the panel 2 performs the function of instantaneously displaying a play result on the 7-segment digital display set 22 according to the programmed scoring regulations.

A third prior art dart device shown in FIG. 3 includes a dart panel 3 divided into many target blocks 301, 302, 303 and 304 programmed to have different scores, four 7-segment digital display sets 31 at the lower part of the dart panel 3 and many indicating diodes 32. The 7-segment digital displays 31 display the scoring of the target blocks 301, 302, 303 and 304 which have been hit with darts, and the indicating diodes 32 display the play result which the player gains during the game.

The rules of cricket can be exemplarily illustrated with the help of the third prior dart device. Who will win or lose one game depends on who first hits the target blocks respectively marked 20, 19, 18, 17, 16, 15 and the bull's-eye with darts. Taking the block marked with 20 as an example, if the block 302 or 304 is hit with a dart, then one of the three light emitting diodes (LED) 321, 322 and 323, will be illuminated for denoting that the block marked 20 has been hit with a dart once; if the block 303 is hit with a dart, then all three LEDs 321, 322 and 323 will be illuminated simultaneously for imaginarily denoting that the block marked 20 has been hit three times; and if the block 301 is hit with a dart, then two of the three LEDs 321, 322 and 323 will be illuminated for assumedly denoting that the block marked 20 has been hit twice. The winner will be the first one who hits all of the blocks marked 20, 19, 18, 17, 16, 15 and the bull's-eye three times.

Compared with the first and the second prior dan devices, the third prior dart device provides a function for automatically recording the result of the cricket game. To achieve this function, the dart device has to be equipped with 21 LEDs for displaying the times when each block is hit and a driving circuit for driving those LEDs. Consequently, though the third prior electronic dart device can provide a function for automatically recording the result of a cricket game, it does so at a higher cost. An electronic dart device similar to the third piece of prior art can be referred to the U.S. Pat. No. 4,567,461.

To decrease the cost of such a dart device and still perform the function of automatically recording the result of a cricket game, U.S. Pat. No. 5,318,319 provides a fourth prior art electronic dart device as shown in FIG. 4. The fourth electronic dart device includes a target panel 4, two 7-segment digital display sets 41 and LED sets 421–427 for recording the play result in the game wherein each of the LED sets 421–427 consists of two LEDs having different colors. Taking target block 431 marked 20 as an example, when the target block 431 is hit with a dart once, the LED of set 421 having the first color will be illuminated; when the block 431 is hit a second time, only the second color LED of set 421 having the second color will be illuminated; and when the block 431 is hit a third time, then both of the LEDs or the LED set 421 will be illuminated.

No matter which prior dart device is used, to record the result of a cricket game, the dart device should include LED's and an LED driving circuit which not only occupy space on the dart panel, but also increase the cost of producing the dart device.

SUMMARY OF THE INVENTION

One object of the present invention is to provide an electronic dart device for playing a cricket game and showing a play result so as to decrease the area of the dart panel and reduce the manufacturing cost.

In accordance with the present invention, an electronic dart device for playing a cricket game and showing a play result includes a dart panel having a plurality of dart regions, a plurality of target blocks respectively received in the plurality of dart regions, a sensing matrix circuit in contact with one of the target blocks when the one target block is hit with a dart, a digital display mounted on the dart panel for displaying a sign denoting a time the one hit block has been hit in a first instance and a number denoting a score the one hit block is programmed to have in a second instance, and a control circuit electrically connected to the matrix circuit and the digital display for controlling the digital display to display one of the sign and the number when the one hit block is hit.

In accordance with the present invention, the digital display is a 7-segment digital display.

In accordance with the present invention, the control circuit includes a micro-controller electrically connected to the sensing matrix circuit having an output and generating a control signal for controlling the 7-segment digital display in response to the output of the sensing matrix circuit, and a driving circuit electrically connected to the micro-controller and the 7-segment digital display and driving said 7-segment digital display according to the controlling signal in order to display the display result.

In accordance with the present invention, the driving circuit includes a source current transistor array and a segment driver.

In accordance with the present invention, the sign is expressed by an Arabic number.

In accordance with the present invention, the sign is expressed by an illuminated segment of said digital display.

The present invention may best be understood through the following description with reference to the accompanying drawings.

DETAILED DESCRIPTION OF THE PREFERRED EMBODIMENT

Figure 1:
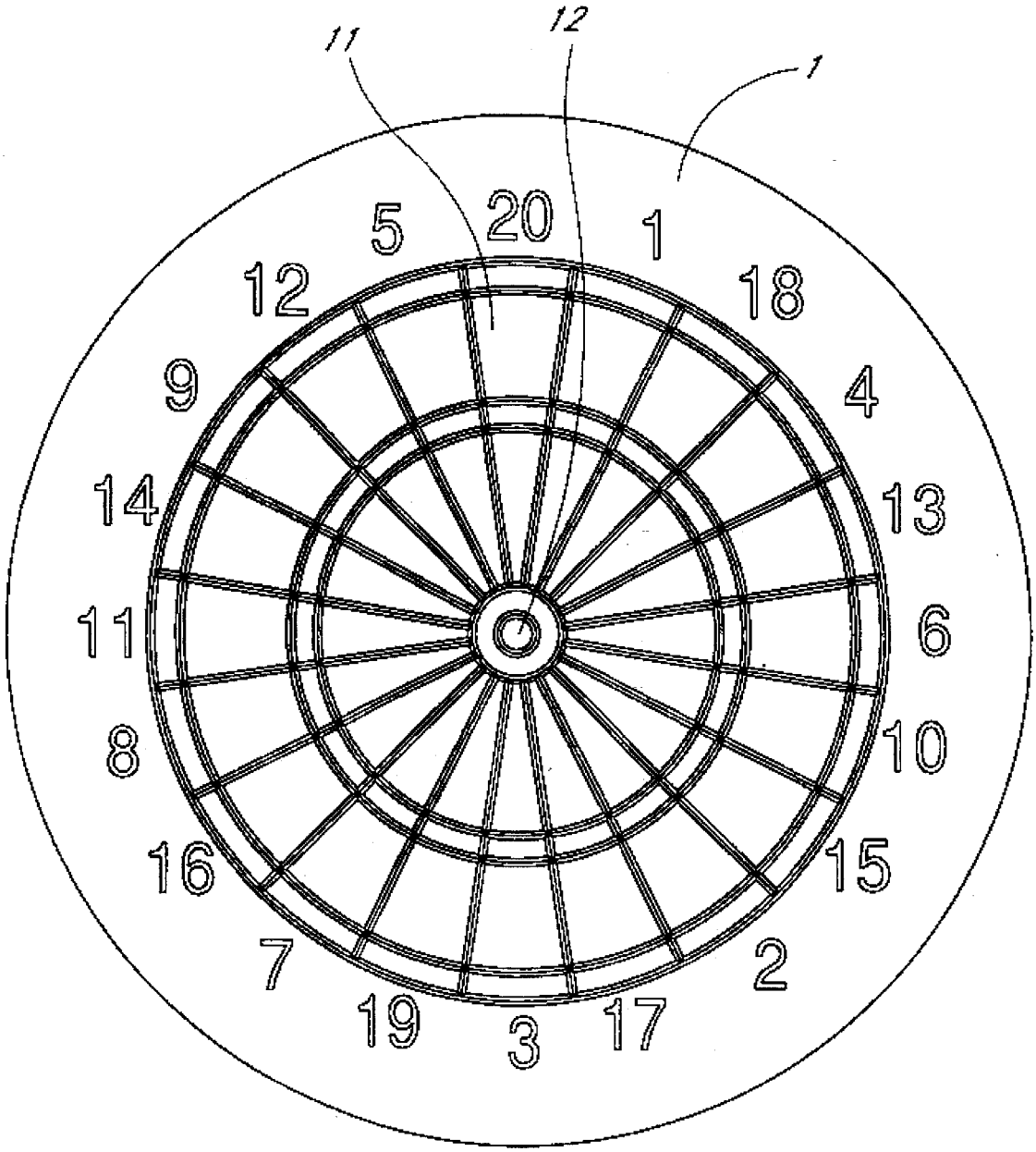
Fig. 1 (Prior Art)
FIG. 1 is a schematic view of a first prior dart device.
Figure 2:
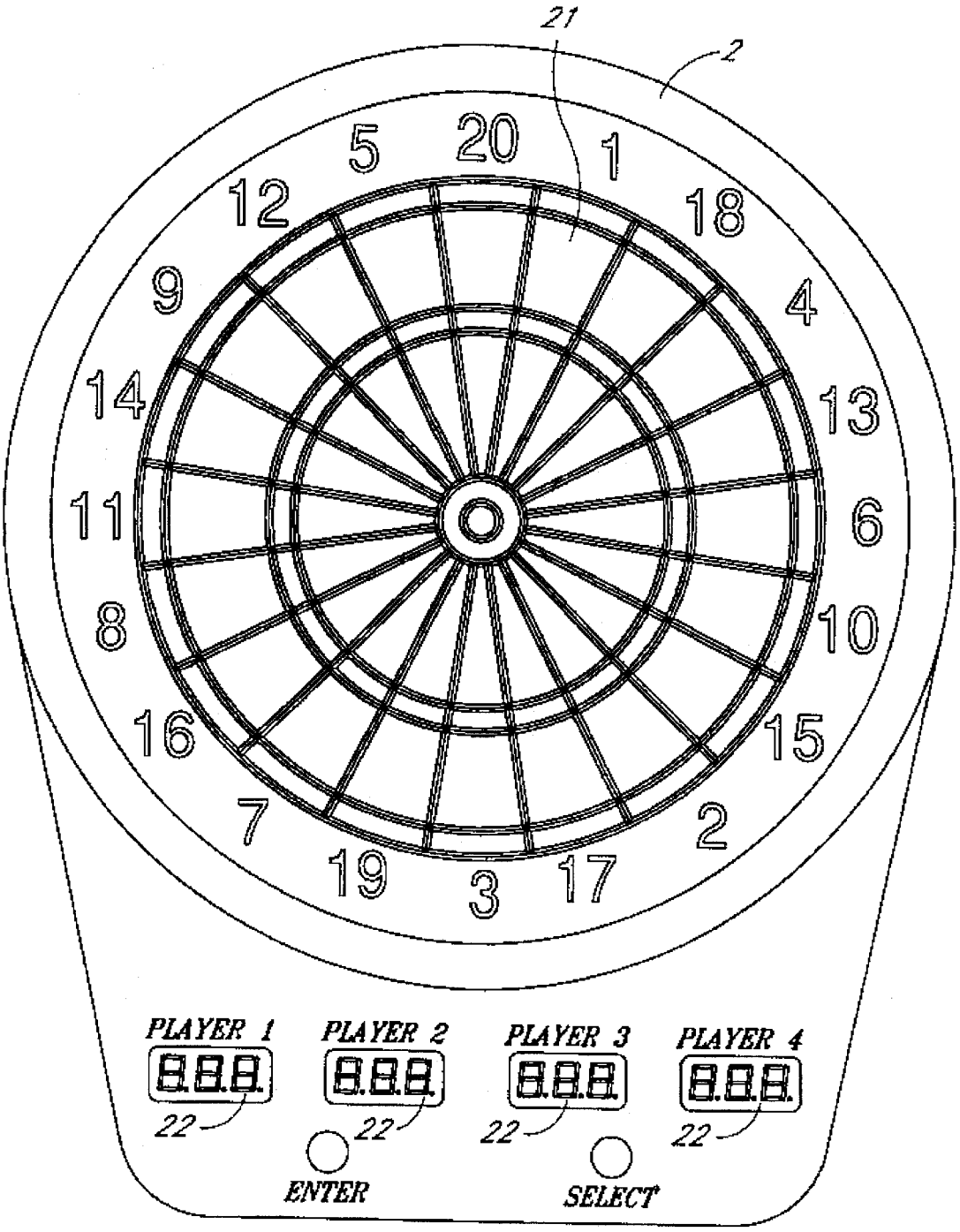
Fig.2 (Prior Art)
FIG. 2 is a schematic view of a second prior art dart device.
Figure 3:
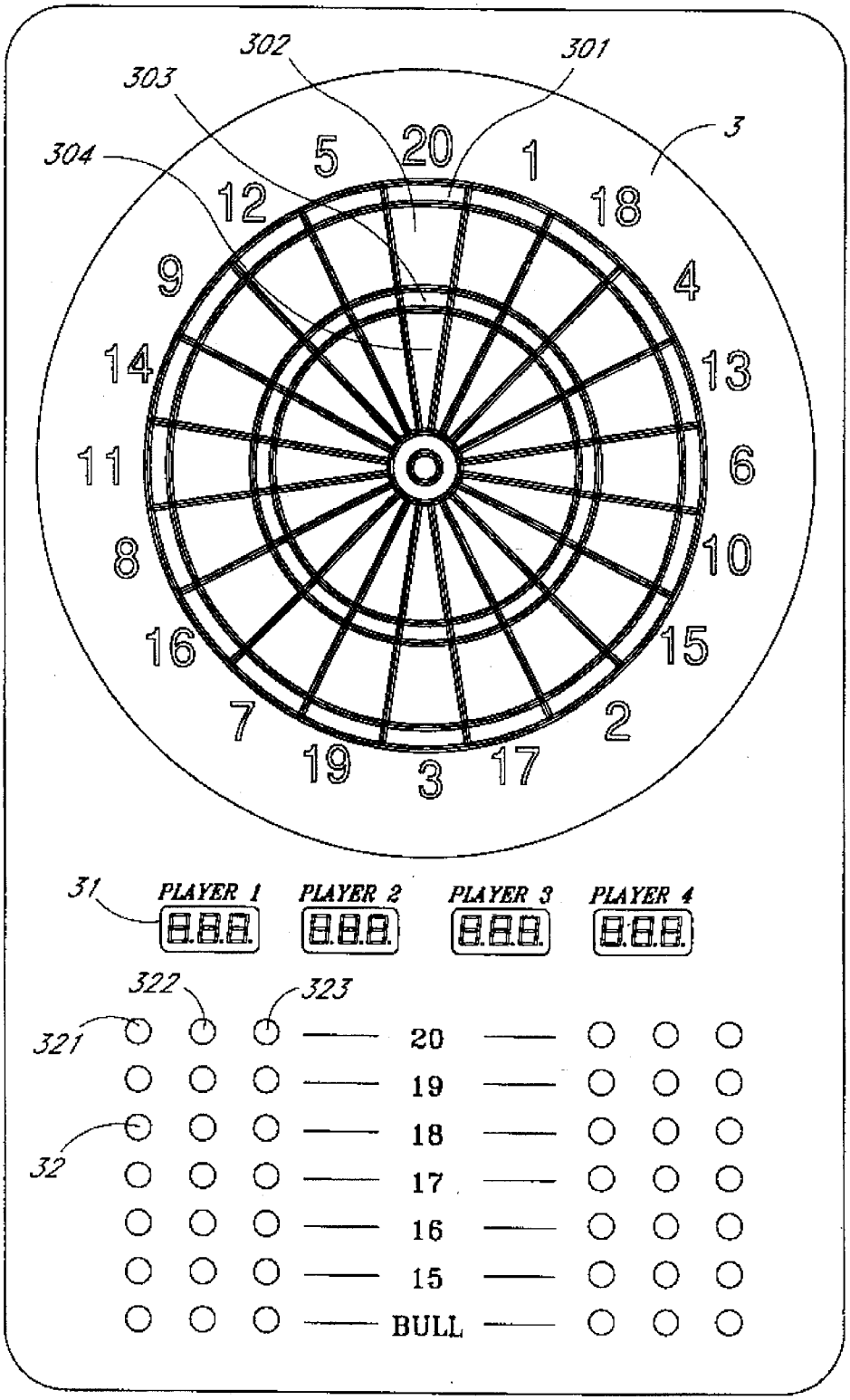
Fig. 3 (Prior Art)
FIG. 3 is a schematic view of a third prior art dart device.
Figure 4:
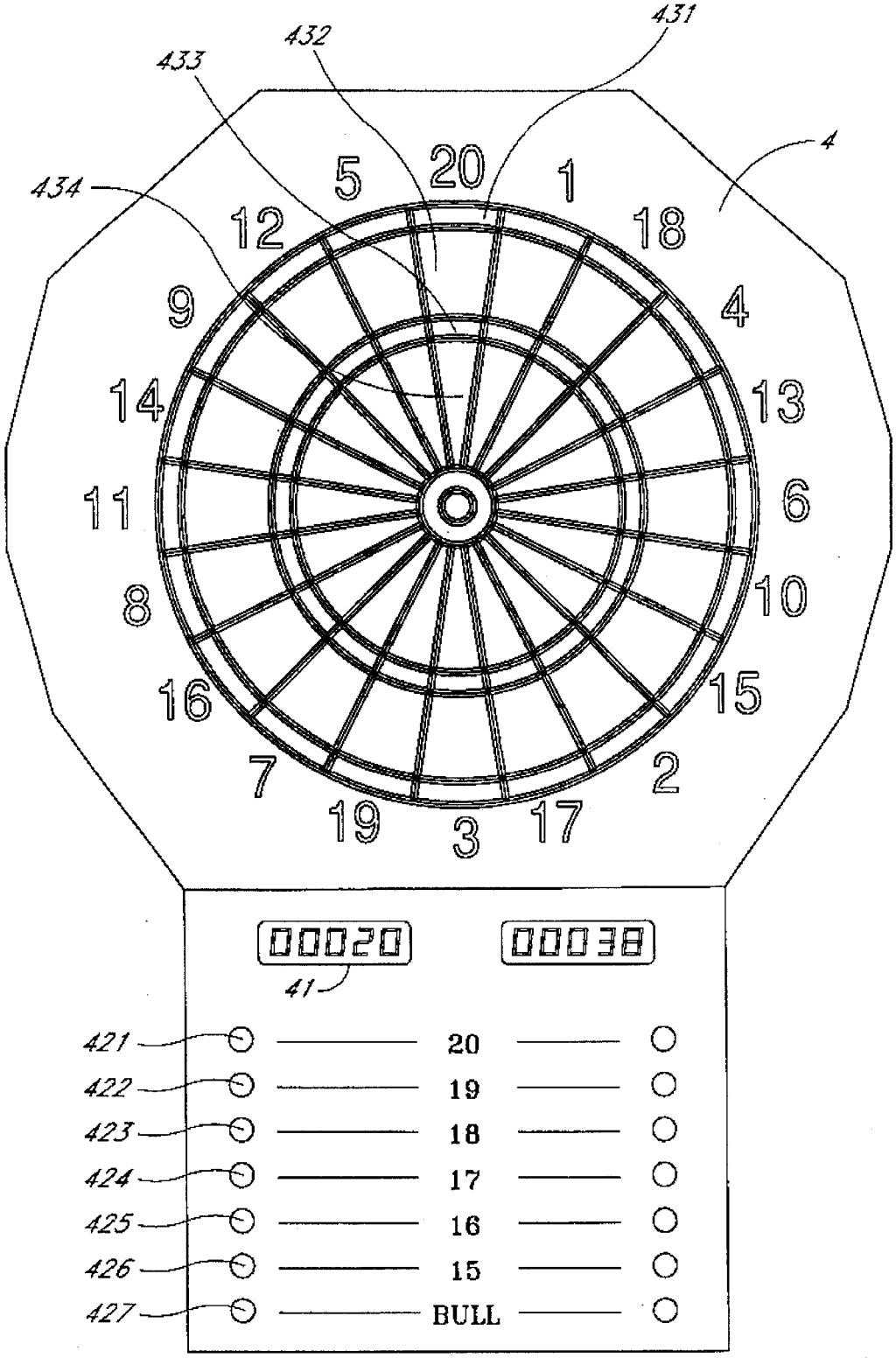
Fig. 4 (Prior Art)
FIG. 4 is a schematic view of a fourth prior art dart device.
Figure 5:
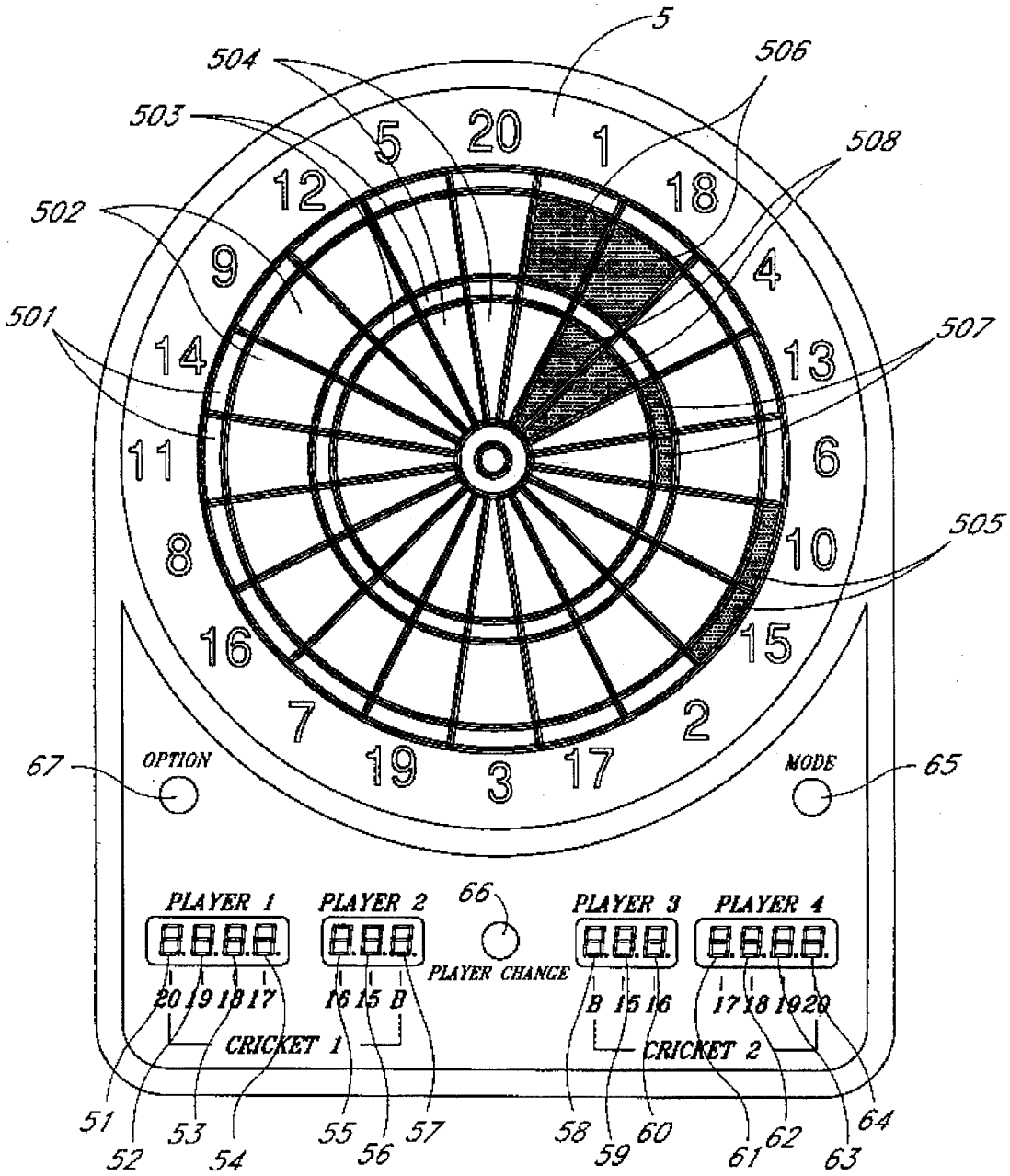
FIG. 5 is a schematic view showing a preferred embodiment of an electronic dart device for playing a cricket game and showing a play result according to the present invention.
Figure 6A:
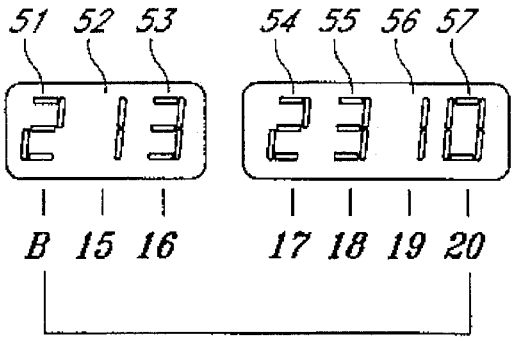
FIGS. 6(*a*)–6(*d*) are schematic views of the 7-segment digital displays showing some exemplary recording instances according to the present invention.
Figure 6B:
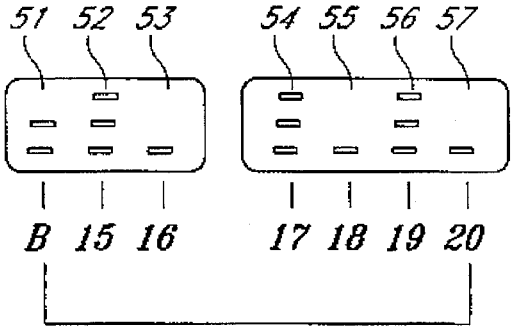
Figure 6C:
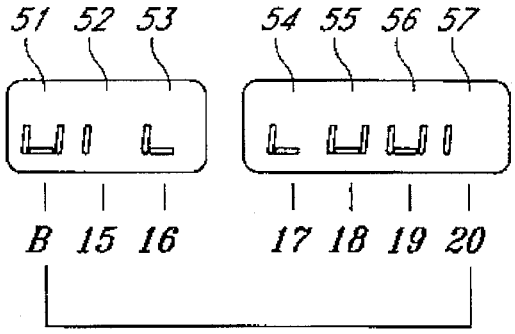
Figure 6D:
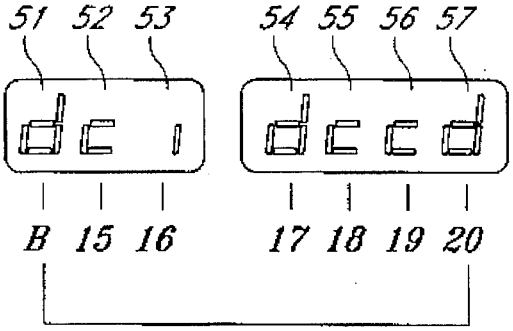

Referring to FIG. 5, a dart device according to the present invention has a dart panel 5 axially and radially divided into several dart regions 501–504 for respectively receiving therein a plurality of dart blocks 505–508, 7-segment digital displays 51–64 and buttons 65, 66 and 67.

Button 65 is a MODE selector for choosing the desired playing or scoring manner, such as successive adding scoring, successive subtracting scoring (e.g., 301 or 501), or cricket. etc. Button 67 is an OPTION selector for choosing the desired game. Button 66 is a PLAYER CHANGE actuator for choosing one of the players 1, 2, 3 and 4 in his turn for scoring. In the preferred embodiment in FIG. 5, if the play result of the game is to be scored, then the 7-segment digital display sets 51–54, 55–57, 58–60 and 61–64 are respectively applied for recording the play results of the players 1, 2, 3 and 4. If the cricket game is desired, then the 7-segment digital displays 51–57 will respectively display the number of times that the blocks 20 - 15 and the bull's-eye have been hit by player 1 and the 7-segment digital displays 58–64 will display the results obtained by the player 2.

More detailed exemplary recording instances are to be referred to FIGS. 6(*a*)–6(*d*). In FIG. 6(*a*), the numbers shown in the 7-segment digital displays 51–57 respectively denote the number of times the bull's-eye, and blocks marked 15, 16, 17, 18, 19 and 20 have been hit. In FIG. 6(*b*), the number of the three non-successive illumining pans of each of the 7-segment digital displays 51–57 denotes when and the number of times a specific block has been hit. In FIG. 6(*c*), the number of the three lower segments of each of the 7-segment digital displays 51–57 denotes the darted time of a specific block. In FIG. 6(*d*), the alphabet (e.g., "d" (double) standing for hit twice, "c" (close) for darted three times . . . etc.) in each of the 7-segment digital displays 51–57 denotes the hit time of a specific block. Certainly, FIGS. 6(*a*)–6(*b*) are some preferred embodiments only, and do not exclude other 7-segment digital display manners having similar characteristics as those of the present invention.

Figure 7:
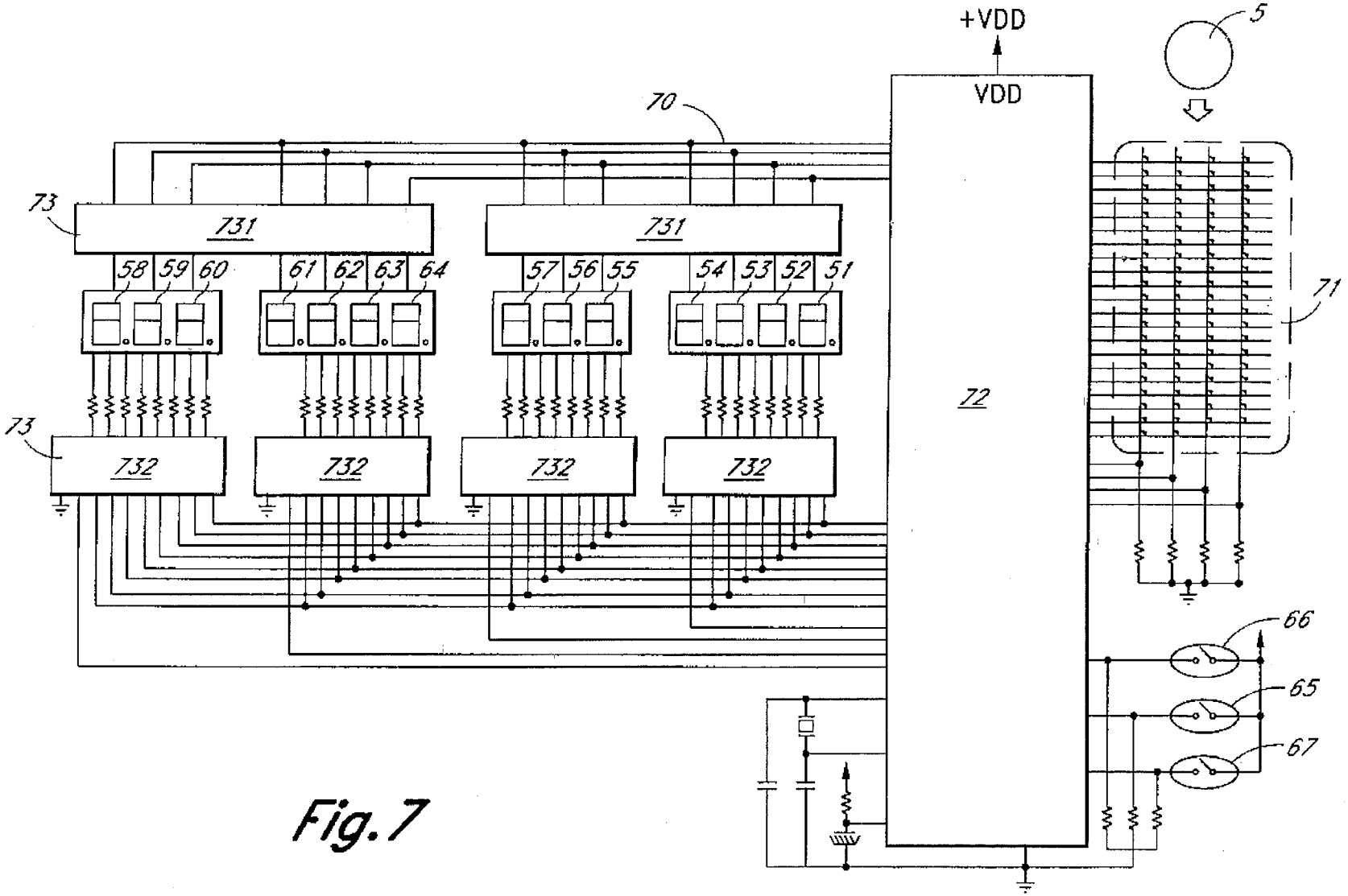
FIG. 7 is a schematic view showing a preferred embodiment of the controlling circuit of the present invention.

FIG. 7 shows a sensing matrix circuit 71, a micro-controller 72, a driving circuit 73 and buttons 65, 66 and 67, wherein the driving circuit 73 includes a source current transistor array 731 and a segment driver 732.

The sensing matrix circuit 71 is in contact with the dart panel 5 for sensing the blocks of the dart panel that are hit. Micro-controller 72 is electrically connected to and receives output signals from the sensing matrix circuit 71 and generates control signals to control circuit for controlling the 7-segment digital displays 51–64 so as to display results for all kinds of games.

The present invention uses the 7-segment digital displays which originally are required elements for a dart game to alternatively display the results of the cricket game for reducing the installation cost of the light-emitting diodes. In addition, without the installation of the LEDs, the present invention also achieves the effect of decreasing the area of the dart panel.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic dart device adapted to be used for playing a cricket game, comprising:

a dart panel having a plurality of dart regions;

a plurality of target blocks respectively received in said plurality of dart regions;

a sensing matrix circuit in contact with at least one of said target blocks;

a digital display mounted on said dart panel for displaying a sign denoting a number of times that the target block in contact with said matrix circuit has been hit with a dart and for displaying a number denoting a score that said target block is programmed to have when said target block has been hit with a dart; and a control circuit electrically connected to said matrix circuit and to said digital display for controlling said digital display's display of one of said sign and said number when said target block has been hit with a dart.

2. An electronic dart device according to claim 1, wherein said digital display is a 7-segment digital display.

3. An electronic dart device according to claim 2, wherein said control circuit includes:

a micro-controller electrically connected to said sensing matrix circuit having an output and generating a control signal for controlling said 7-segment digital display in response to said output of said sensing matrix circuit; and a driving circuit electrically connected to said micro-controller and said 7-segment digital display and driving said 7-segment digital display according to said controlling signal in order to display said display result.

4. An electronic dart device according to claim 3, wherein said driving circuit includes a source current transistor array and a segment driver.

5. An electronic dart device according to claim 4, wherein said sign is expressed by an Arabic number.

6. An electronic dart device according to claim 4, wherein said sign is expressed by an illuminated segment of said digital display.

* * * * *